United States Patent [19]

Stanley

[11] Patent Number: 4,696,316

[45] Date of Patent: Sep. 29, 1987

[54] STAND FOR POLISHING ARTIFICIAL FINGERNAILS

[76] Inventor: Sandra M. Stanley, 2603 Massachusetts Ave., Lemon Grove, Calif. 92045

[21] Appl. No.: 817,593

[22] Filed: Jan. 10, 1986

[51] Int. Cl.[4] ..... A45D 29/00

[52] U.S. Cl. ..... 132/73

[58] Field of Search ..... 128/73, 88.5, 73.5; 206/581, 823; 248/127; D28/61

[56] References Cited

U.S. PATENT DOCUMENTS

| | | | |
|---|---|---|---|
| D. 239,661 | 4/1976 | Goergen | D28/61 |
| 2,299,819 | 10/1942 | Hanson | 132/88.5 |
| 2,300,170 | 10/1942 | Pickard | 132/73 |
| 3,485,344 | 12/1969 | Aylott | 132/73 |
| 3,972,325 | 8/1976 | Bluestone | 132/73 |
| 3,982,551 | 9/1976 | Bartolucci | 132/73 |
| 4,106,614 | 8/1978 | Aylott | 132/73 |
| 4,140,139 | 2/1979 | Aylott | 132/73 |
| 4,575,037 | 3/1986 | Hammar | 248/174 |

FOREIGN PATENT DOCUMENTS

| | | | |
|---|---|---|---|
| 933981 | 8/1963 | United Kingdom | 132/73 |

*Primary Examiner*—Robert Peshock
*Assistant Examiner*—Cary E. Stone
*Attorney, Agent, or Firm*—Charmasson & Holz

[57] ABSTRACT

A stand for retaining and polishing artificial fingernails, comprising an L-shaped leg, a plate, a base having a convex head and a device for releasably attaching the fingernails to the head.

4 Claims, 4 Drawing Figures

STAND FOR POLISHING ARTIFICIAL FINGERNAILS

FIELD OF THE INVENTION

This invention generally relates to manicuring or pedicuring and more particularly to an improved reusable device for retaining and polishing artificial fingernails.

BACKGROUND OF THE INVENTION

The most common way to polish artificial fingernails, is to attach them to the wearers fingers before applying any polish or finish. This method is problematic because the wearer has to wait for the polish to dry before regaining the active use of the fingers. Moreover, the spillover and cleanup are bothersome and time consuming.

Less common polishing methods have been disclosed by the prior art. The Sazdanoff U.S. Pat. No. 4,524,789 is a representative of such methods. The Sazdanoff patent discloses a finger rest for stabilizing a finger during manicuring. This device, while it may partially overcome the spill over problem, does not permit the user to restore the active use of the fingers prior to drying the polish.

A close reference of the prior art is the Robichaud U.S. Pat. No. 4,287,899, which describes a nail form device having a forward portion and a rearward portion. The forward portion comprises an awkwardly convex surface for supporting the synthetic nail. The rearward portion has a downwardly concave surface for supporting the finger to which the synthetic nail is to be attached. While this nail form provides a support for polishing artificial fingernails, it has at least two disadvantages. The first is that it could only accomodate one finger at a time. The second is that it is complex and relatively costly to manufacture.

There is thus a need for a simple to use, aesthetically appealing, reusable, inexpensively manufactured, and which is capable of accomodating at least ten synthetic fingernails.

SUMMARY OF THE INVENTION

The principal object of the invention is to provide a convenient support for artificial fingernails.

Another object of the invention is to allow finishing of the synthetic fingernails with no personal involvement of the wearer.

A secondary object of the invention is to reduce or eliminate spill over and cleanup problems. Spills stay on the stand surface rather than on the user's fingers, and are easily removed from the stand surface.

A further object of the invention is to provide an aesthetically appealing stand which could be used in beauty salons as well as homes.

Yet another object is to provide an affordable stand which is very simple to use.

These and other objects are achieved by the present stand for polishing artificial nails, as described and claimed below.

DESCRIPTION OF THE PREFERRED EMBODIMENT OF THE INVENTION

Figure 1:
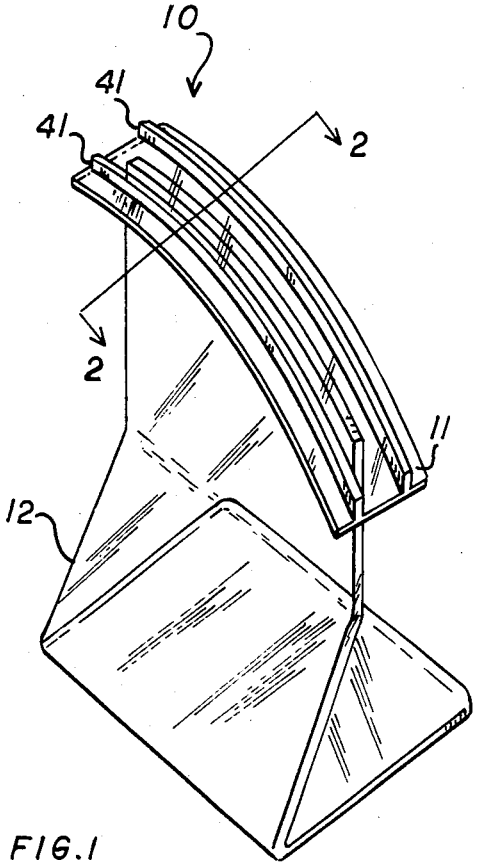
FIG. 1 is a perspective view of the preferred embodiment.
Figure 2:
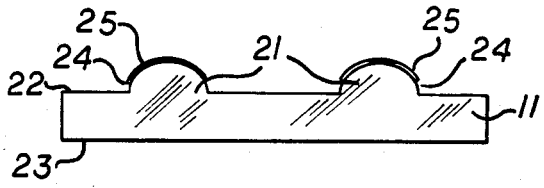
FIG. 2 is a cross-section of the preferred embodiment of the plate along line 2—2 in FIG. 1.
Figure 4:
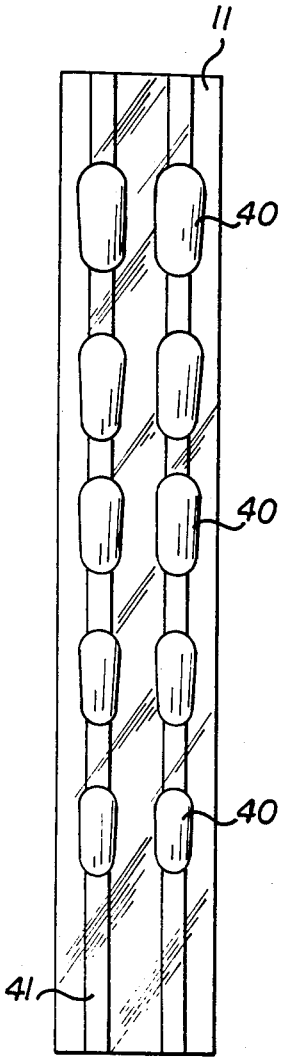
FIG. 4 is a top view of the plate supporting the synthetic fingernails.

Referring now to FIGS. 1, 2 and 4, the preferred embodiment of the present invention comprises a plate 11 and L-shaped leg, a base 41 and a double-sided tape 25.

The plate 11 is of a generally rectangular shape and could be flat, convex, or any other shape which renders the stand 10 aesthetically appealing.

The plate 11 has an upper surface 22 and a bottom surface 23. The bottom surface 23 is attached to a support device or an L-shaped leg 12. The leg 12 provides a self-standing support to the plate. The height of the leg 12 varies with the intended use of the stand. If the stand is to be used on a table the length of the leg 12 is relatively short. Whereas, if the stand is to be placed on the floor, the length 12 is relatively longer.

The upper surface 22 of the plate 11 is attached to a base 41, which functions as a means for retaining the artificial fingernails. The base 41 comprises at least two parallel ridges 21 which extend along the length of the plate 11. Each ridge 21 has a convex head 24 which is shaped and dimensioned to receive, retain and provide elevation to the fingernails.

A double-sided adhesive tape 25 is attached to the convex head and provides a retaining means to the fingernails 40.

Figure 3:
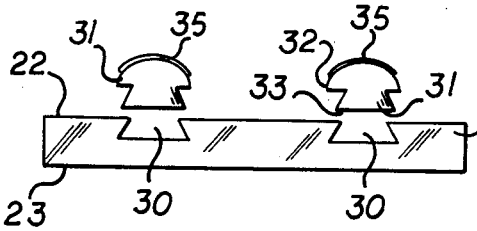
FIG. 3 is a cross-section of a secondary embodiment of the plate along line 2—2 in FIG. 1.

FIG. 3 shows a secondary embodiment of the invention. The difference between the secondary and the preferred embodiments is the means for retaining the fingernails 40. Whereas the preferred embodiment comprises a permanent retaining means in the form of a ridge 21, the secondary embodiment comprises a detachable retaining means.

The plate 11 of the secondary embodiment comprises at least ten mortises 30 in which ten resilient membranes 31 such as rubber plugs of a generally mushroom shape are inserted. The lower part 33 of the resilient membrane 31 snuguly fits within the mortise 30. The upper part 32 of the resilient membrane 31 retains the fingernail 40.

As with the preferred embodiment, one side of a double-sided adhesive tape 35 is attached to the upper part 32 while the other side adheres to the fingernails.

While the preferred embodiment of the invention has been described and modifications thereto have been suggested, other applications could be devised and other changes could be made without departing form the spirit of the invention and the scope of the appended claims.

What is claimed is:

1. A stand for retaining and polishing artificial fingernails, with comprises:

a plate having an upper surface and a bottom surface;

means for supporting the plate, wherein said means for supporting is secured to the bottom surface;

at least one base for supporting fingernails secured to the upper surface;

a releasable means for adhering the fingernails to the base;

wherein the base comprises at least one ridge having a convex head, said head being shaped and dimensioned to receive, retain and provide elevation to the fingernails.

2. The stand of claim 1, wherein the means for adhering comprises a double-sided adhesive tape, one side being attached to the convex head, and the other side retaining the fingernail.

3. A stand for retaining and polishing artificial fingernails, with comprises:

a plate having an upper surface and a bottom surface;

means for supporting the plate, wherein said means for supporting is secured to the bottom surface;

at least one base for supporting fingernails secured to the upper surface;

a releasable means for adhering the fingernails to the base;

wherein the base further comprises:

at least one mortise along the upper surface;

at least one resilient membrane having a lower part and an upper part;

the lower part being sized and dimensioned to fit in said mortise; and the upper part having a generally convex shape, commensurate with the shape of the fingernails.

4. The stand of claim 3, wherein the means for adhering comprises a double-sided adhesive tape, one side being attached to the upper part and the other side securing the fingernail.

* * * * *